US006585803B1

(12) United States Patent
Chang et al.

(10) Patent No.: US 6,585,803 B1
(45) Date of Patent: Jul. 1, 2003

(54) ELECTRICALLY ENHANCED ELECTROSTATIC PRECIPITATOR WITH GROUNDED STAINLESS STEEL COLLECTOR ELECTRODE AND METHOD OF USING SAME

(75) Inventors: Ming-Chih Chang, Alhambra, CA (US); Seongheon Kim, Kangwon-Do (KR); Constantinos Sioutas, Pasadena, CA (US)

(73) Assignee: University of Southern California, Los Angeles, CA (US)

( * ) Notice: Subject to any disclaimer, the term of this patent is extended or adjusted under 35 U.S.C. 154(b) by 0 days.

(21) Appl. No.: 09/569,351

(22) Filed: May 11, 2000

(51) Int. Cl.[7] ..... B03C 3/47

(52) U.S. Cl. ..... 95/70; 55/525; 96/59; 96/66; 96/67; 96/96; 96/97

(58) Field of Search ..... 96/66, 67, 69, 96/100, 96–98, 59; 95/57, 78, 70; 55/360, 523, 525, 527, 524

(56) References Cited

U.S. PATENT DOCUMENTS

| | | | | | |
|---|---|---|---|---|---|
| 2,847,082 | A | * | 8/1958 | Roos | 96/67 |
| 4,317,661 | A | * | 3/1982 | Sasaoka et al. | 96/67 |
| 4,339,782 | A | * | 7/1982 | Yu et al. | 96/97 X |
| 5,403,383 | A | * | 4/1995 | Jaisinghani | 95/78 X |
| 5,695,549 | A | * | 12/1997 | Feldman et al. | 96/97 X |
| 5,792,241 | A | * | 8/1998 | Browitt | 96/97 X |
| 5,951,742 | A | * | 9/1999 | Thwaites et al. | 96/97 X |
| 6,176,902 | B1 | * | 1/2001 | Matsubara | 96/97 X |
| 6,228,149 | B1 | * | 5/2001 | Alenichev et al. | 96/97 X |
| 6,231,643 | B1 | * | 5/2001 | Pasic et al. | 96/69 X |

FOREIGN PATENT DOCUMENTS

| | | |
|---|---|---|
| EP | 0 424 335 A2 | 4/1991 |
| EP | 0 627 263 A1 | 12/1994 |
| FR | 66769 | 9/1957 |
| FR | 2 798 303 A1 | 3/2001 |

* cited by examiner

*Primary Examiner*—Richard L. Chiesa
(74) *Attorney, Agent, or Firm*—Fish & Richardson P.C.

(57) ABSTRACT

A sintered stainless steel filter is used as the grounded electrode of a point-to-plane electrostatic precipitator. Particles flow through, rather than parallel to, the collection plate. Particle collection efficiency is empirically shown to increase as the charged particles are drawn closer to the grounded filter. The utilization of stainless steel fiber filter provides (1) low particle penetration (high particle collection efficiency) of different particle range, (2) applicability to all different particulate components, (3) high loading capacity but low pressure drop (less energy and maintenance needed), (5) low electric voltage for operating the system, and (6) low cost and small dimension.

22 Claims, 10 Drawing Sheets

ELECTRICALLY ENHANCED ELECTROSTATIC PRECIPITATOR WITH GROUNDED STAINLESS STEEL COLLECTOR ELECTRODE AND METHOD OF USING SAME

BACKGROUND

The present disclosure describes an electric air filtration device. More specifically, this disclosure describes a device that applies an electric field to charge particles to be removed from a gaseous stream during filtration.

Particulate matter removal from a gaseous stream using a fibrous mat has been a long-established process. Particle accumulation increases the collection efficiency of mechanical fibrous filter but also increases the pressure drop (or resistance) across the filter. The continuous increase in pressure drop leads to filter clogging, which is typically demonstrated by an abrupt increase in pressure drop with loading.

Air filtration systems can utilize electronic or electrostatic technology to enhance the performance of the filtration medium. Electrical air filters can obtain a higher efficiency from a given mechanical filter because electricity is used to induce a polarization state in the fibers of a non-metallic filtration medium. The applied electric field also induces a polarization state in at least some of the particles within the air stream to be filtered. The electrostatic forces in the particles and the filter medium attract one another to bind the particles to the medium. These forces of electrostatic attraction can increase the filtration efficiency of a given filtration medium by several fold.

In a typical electrostatic precipitator, charged particles travel in a flow direction which is parallel to the charged collection plate. During precipitation, undesirable re-suspension of particles previously collected on the collection plate to the air stream occurs.

SUMMARY

The present application describes techniques of filtering air using electrostatic charges.

DETAILED DESCRIPTION

The present disclosure uses a sintered stainless steel filter as the grounded electrode of a point-to-plane electrostatic precipitator. In the preferred embodiment, particles flow through, rather than parallel to, the stainless steel filter. Particle collection efficiency is empirically shown to increase as the charged particles are drawn closer to the filter.

In one aspect, an electrically enhanced point-to-plane precipitator is provided with a metal fibrous filter which is adapted for coupling to a grounded electrode of a power supply. The precipitator also includes particle charging electrodes, pointed in the direction of the metal fibrous filter, and adapted for coupling to a non-grounded electrode of the power supply. The precipitator is orientated such that a gaseous stream is drawn from the charging electrodes toward and through the metal fibrous filter to effect particle filtration during application of an electrical field across the grounded and non-grounded electrodes of the power supply. A preferred metal fibrous filter is made of stainless steel.

The specific utilization of a stainless steel fiber filter is shown to provide (1) low particle penetration (high particle collection efficiency) of different particle range, (2) applicability to all different particulate components, (3) high loading capacity but low pressure drop (less energy and maintenance needed), (5) low electric voltage for operating the system, and (6) low cost and small dimension.

Other salient features and advantages will become apparent to those skilled in the art upon the reading of the discussion below, in addition to a review of the accompanying drawings.

Figure 1:
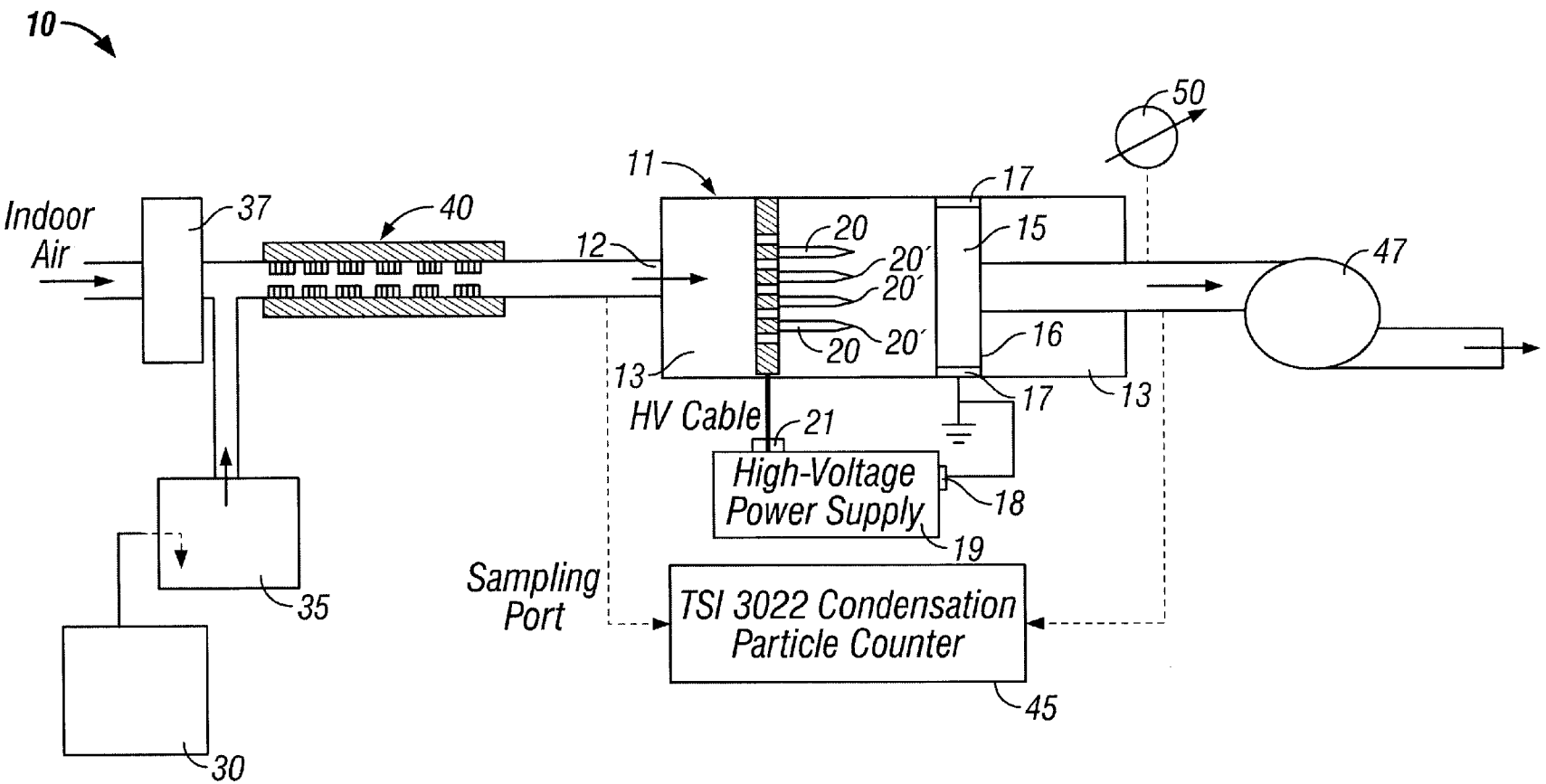
FIG. 1 shows an experimental setup of an air filtration device including a point-to-plane electrostatic precipitator provided with a stainless steel filter in accordance with a preferred embodiment.

FIG. 1 shows an embodiment of an air filtration device 10 including a point-to-plane electrostatic precipitator 11 provided with a stainless steel filter 15 of a special type is used. The air filtration device is used to describe the effect of particle size and composition, as well as the effect of filter face velocity on particle penetration, when a sintered stainless steel metal filter is used as the grounded collection electrode.

Point-to-plane precipitator 11 includes an inlet 12 an aerosol, e.g. a fluid flow with some particular matter is a drain through the precipitator. The precipitator 12 includes a glass cylinder 13, 4.8 cm in diameter and 20 cm long. A sintered stainless steel filter 15, made of standard AISI 316L stainless steel with a fiber diameter of 20 $\mu$m, such as manufactured by Fairey Microfiltrex Ltd., is placed inside an open-face 4.7-cm filter holder 17 and connected to the ground terminal 18 of a high-voltage power supply 19. Particle charging electrodes, comprised of four stainless-steel wires 20, are positioned perpendicular to a facing surface 16 of stainless steel filter 15, and at a distance of 1.25 cm from surface 16.

The wires 20 are substantially 0.2 cm in diameter and machined to end as a conical tip 20' with an approximate cone angle of 45°. Any wire-tip configuration capable of facilitating corona discharge is suitable. The wires 20 are connected to an opposite electrode 21 of the high-voltage power supply 19. In the experimental arrangement, a 14 kV DC voltage is applied to the wires 20. A positive voltage is preferable since the ozone generation is suppressed in a positive corona as compared with a negative corona. Negative coronas can produce high ozone production.

In the embodiment, the wire 20 orientation is such that conical tips 20' form a square, the sides of which are 1.25 cm long. This can form more even distribution of the electric field over the filter facing surface 16. The current at the filter facing surface 16 corresponding to this configuration is 28 $\mu$A (±2).

The configuration in FIG. 1 differs from traditional designs of point-to-plane precipitators. In the FIG. 1 system, particles flow through, rather than in parallel to, the grounded collection plate corresponding to the filter 15. The flow-through configuration increases particle collection efficiency as the charged particles are drawn closer to the grounded filter.

Many particle collection devices are limited by collection efficiency of the particle size, capacity of the device, cost and the characterization of different particulates. Using a stainless steel fiber filter of this type has certain advantages. It provides low particle penetration (high particle collection efficiency) of different particle range. The filter is applicable to many different particulate components. It has high loading capacity but low pressure drop, so less energy and maintenance is needed. The system can be more efficient-operating with less low electric voltage and power and smaller dimension.

Electrostatic Precipitation Area

The effective electrostatic precipitation surface area of a filter is estimated by knowing the filter mass (m), the filter fiber diameter ($d_f$), and the density of the fibers ($\rho_f$=7.8 g/cm$^3$ for stainless steel). The filter weight, in turn, is given by the following equation:

$$m = \frac{\pi}{4} d_f^2 l_f N_f \rho_f \tag{1}$$

where $N_f$ and $l_f$ are the number of fibers in the filter and the fiber length, respectively. The surface area of the fibers can then be determined as follows:

$$A_f = N_f \pi l_f d_f = \frac{4m}{d_f \rho_f} \tag{2}$$

The filter 15 used in the air filtration device 10 shown in FIG. 1 has a filter diameter of 20 $\mu$m, is 4.7 cm in diameter, and 0.05 cm in thickness. Based on equations (1) and (2), the calculated fiber surface area is about 360 cm$^2$. This area is also equivalent to the effective electrostatic precipitator area of the filter used in the experiment.

Experimental Procedure

The experimental setup for characterizing the collection efficiency of the stainless steel filter will now be described in greater detail. Suspensions of monodisperse fluorescent yellow-green latex microspheres, commercially available from Polysciences, under the trade name Fluoresbrite™, are atomized with a pocket nebulizer 30. A suitable nebulizer is manufactured by VORTRAN Medical Technology, Inc. Particle size ranges from 0.05 to 1 $\mu$m. The volumetric flow rate of the nebulizer 30 is estimated to be approximately 5.5 LPM and the output is approximately 0.25 cm$^3$/min of fluorescent suspension. The nebulizer 30 is connected to a syringe pump 35 in order to atomize large amounts e.g. 120 mL of a fluorescent suspension. The output of the nebulizer 30 is maintained constant to ensure a stable atomization process. The generated aerosol from syringe pump 35 is mixed with clean (particle-free) air which may be output, for example, from a HEPA filter 37, and then drawn through a 1-L cylindrical chamber 40. Chamber 40 functions as a neutralizer and includes ten Polonium 210 ionizing units that reduce electrostatic charges carried by the generated particles to the Boltzmann equilibrium. From the chamber 40, the resultant aerosol is drawn through the electrostatic precipitator 11.

A Condensation Particle Counter (CPC) 45, such as Model CPC 3022 manufactured by TSI Inc., is used to measure particle concentration upstream and downstream of the filter 15, with and without the application of the electrical field. For each test to be described in greater detail below, a concentration of the generated aerosol is first measured. A concentration downstream of the filter 15 is then measured in order to estimate the collection efficiency of the filter 15 itself without the use of the electrical field. Subsequently, a voltage is applied to the four wires 20 and the concentration downstream of the filter 15 is measured again. The field is then terminated and another measurement downstream of the filter 15 is again taken, followed by a final measurement of the concentration of the generated aerosol upstream of the filter 15. Each experimental cycle lasts approximately 5 minutes. At least two to three tests are conducted for each particle size and each experimental configuration.

In order to investigate the effect of particle dielectric properties, suspensions of monodisperse silica beads are generated. Particle size range from 0.15 to 0.9 $\mu$m. In addition, aqueous solutions of ammonium nitrate (70 ppm) and ammonium sulfate (80 ppm) are also atomized. The mass median diameters are approximately 0.22 and 0.25 $\mu$m for ammonium nitrate and sulfate, respectively, as was determined with a Microorifice Uniform Deposit Impactor (MOUDI). The relative permittivities of polystyrene latex, silica, ammonium sulfate and ammonium nitrate are 2.6, 4.5, 9.8 and 10.7, respectively. The experimental procedure for each particle size and type is otherwise identical to that described above. These experiments can determine whether particles consisting of conductive materials (ammonium nitrate and sulfate ) are collected more efficiently than those consisting of non-conductive material (PSL, silica). Finally, indoor air is used as the test aerosol. As particle concentration measurement by the CPC 45 is based on particle number, it is expected that the indoor air measurements to be dominated by the contribution of ultrafine (smaller than 0.1 $\mu$m) particles.

For each particle size and type, tests were conducted at the following filter face velocities: 25, 50, 100 and 125 cm/s, respectively. It should be noted that these velocities are considerably higher (i.e., by a factor of 10 to 100) than typical filtration velocities used in conventional or electrically active filters.

The CPC 45 measures particle concentration by counts without providing any information on particle size. It was assumed in our tests that all particle counts are associated with the monodisperse PSL particles. Aerosols produced by atomizers include both PSL spheres and impurity particles resulting from evaporation of droplets which do not contain a PSL particle. The fraction of impurities can be reduced when distilled or deionized water is used to dilute the PSL particle suspension. Although the PSL and silica particles that were generated by atomization in our tests were diluted by ultrapure deionized water, we conducted a comparative series of experiments, in which we used fluorescence detection instead of the CPC counts to determine particle penetration through the stainless steel filter. Specifically, two glass fiber filters (2 $\mu$m pore) were placed immediately upstream and downstream of the test chamber (containing the wires and the grounded filter). Each filter was connected to a pump 47 sampling at the same flow rate for both filters. Monodisperse fluorescent PSL aerosols were generated by atomization as before and were drawn through the test chamber. At the end of each experiment, the glass fiber filters were extracted in 3-mL ethyl acetate. The quantity of fluorescent dye was measured by a fluorescence detector. Particle penetration is then determined by dividing the concentration of fluorescence of the downstream to that of the upstream filter.

Capacity Tests

A concern in electrostatic precipitation as well as in the use of electrically active (Electret) filters is the possible degradation of the collection efficiency with particle loading. This degradation might be due to the accumulation of particles of very high resistivity on the collector plate. In electrostatic precipitators, particles with high resistivity do not transfer their charge to the ground electrode as rapidly as conductive particles, and their accumulation on the plate results in the build-up of a charge having the same polarity with that of the charging electrode. This phenomenon is known as "back corona" and results in a substantial reduction in the migration velocity of the incoming particles and thus in a decrease in the collection efficiency of the precipitator. In filtration, particle accumulation often causes an increase in pressure drop across the filter. This increase is initially quasi-linearly dependent on loading, but after a certain loading value is exceeded, pressure drop increases exponentially with loading and results in filter clogging.

In order to investigate the effect of particle loading on the performance of the electrically enhanced sintered stainless steel filter, monodisperse 0.1, 0.2, 0.5 and 0.75 $\mu$m PSL as well as monodisperse 0.15 and 0.5 $\mu$m silica particles are used. The experimental setup was identical to that described in the previous paragraphs. Particle concentrations ranged from 220 to 570 $\mu g/m^3$. The filter sampling flow rate was 40 LPM, corresponding to a face velocity of 50 cm/s. Pressure drop was also recorded continuously across the filter 15 with a Magnehelic differential pressure gauge 50. Before the experiments, the stainless steel filter 15 was carefully cleaned and weighed using a Mettler 5 Microbalance in a controlled temperature and relative humidity room. Subsequently, the ground and voltage cables of the high-voltage power supply 19 were connected to the stainless steel filter 15 and the wires 20, respectively, and particle sampling started. Particle penetration and pressure drop were simultaneously measured and recorded at regular intervals by the CPC 45 and Magnehelic pressure gauge 50 (full scale: 5 inches of $H_2O$), respectively. Finally, the filter was weighed periodically, at time intervals varying from 1 to 2 hours, in order to determine particle loading.

Results And Discussion

Particle removal without the application of an electrical field

Figure 2:
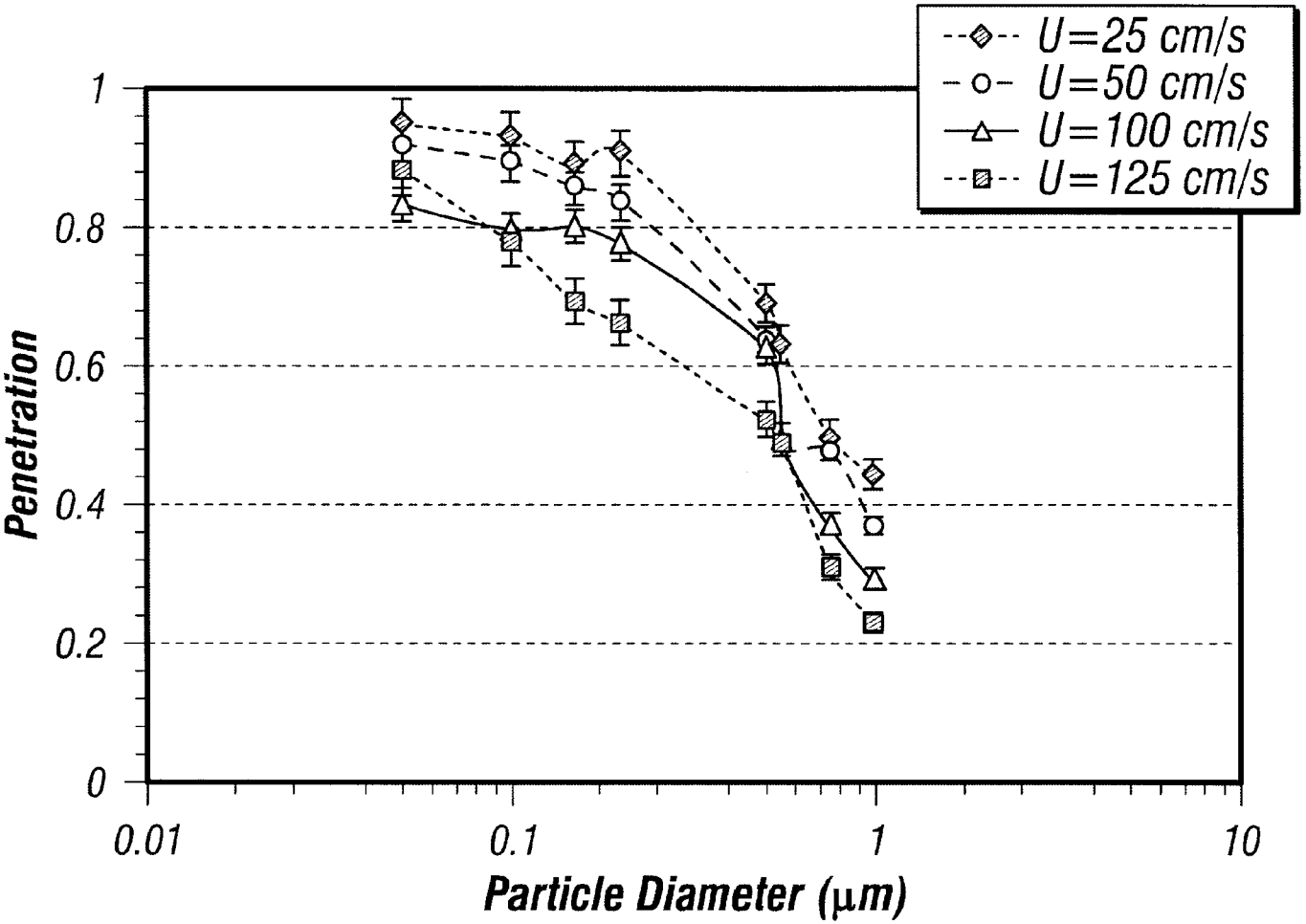
FIG. 2 shows penetration as a function of particle size for a 20 $\mu$m sintered stainless steel fiber filter for different filter face velocities

FIG. 2 shows a plot of particle penetration for an uncharged stainless steel filter 15 at different face velocities. It can be seen that particle penetration decreases significantly with increasing particle size for the filtration velocity range at which the experiments were conducted (e.g., 25–125 cm/s). The curves shown in FIG. 2 do not resemble the typical particle penetration curves of fibrous filters, with a single maximum penetration size range at about 0.1–0.3 $\mu$m. The relationship between particle size and penetration in fibrous filters, however, has been usually studied at substantially lower filtration velocities (i.e., 1–10 cm/s) compared to those of the present study, using filters with a higher porosity (i.e., on the order of 90–95%) compared to the estimated 79% porosity of the 20 $\mu$m stainless steel filter. The combination of high filtration velocities and low porosity would make particle impaction and interception on the stainless steel filter fibers the predominant mechanisms for particle deposition.

Effect of Particle Charge

FIGS. 3(A)–3(D), 4 and 5 show the results from the performance evaluation tests of the stainless steel filter 15 with the application of an electrical field. Particle penetration without the onset of the electrical field is also plotted in order to illustrate the enhancement of filtration related to the electrical field.

FIGS. 3(A)–3(D) show a plot of particle penetration as a function of size for the monodisperse PSL and silica particles at face velocities of 25, 50, 100 and 125 cm/s, respectively. In each figure, particle penetration with and without the onset of the electrical field is plotted as a function of particle physical diameter. The net effect of electrostatic charging on reducing particle penetration can be calculated as follows:

$$P_{charge} = \frac{C_{d,ch}}{C_{d,f}} = \frac{P_{charge+filter}}{P_{filter}} \tag{3}$$

where $P_{filter}$ and $P_{charge+filter}$ are the penetrations through the filter with and without the onset of the electrical field respectively, and $C_{d,f}$ and $C_{d,ch}$ are the measured particle concentrations downstream of the filter with and without the electrical field. Pcharge is also plotted in each figure in order to provide a quantitative estimate of particle penetration reduction due to the electrostatic effects only.

The onset of the electrical field results in a dramatic decrease in particle penetration at a face velocity of 25 cm/s. Particle penetration is reduced from a range of 50–90% to a range of 1% or less for particles in the size range of 0.05 to 1 $\mu$m (FIG. 3(A)).

Figure 3A:
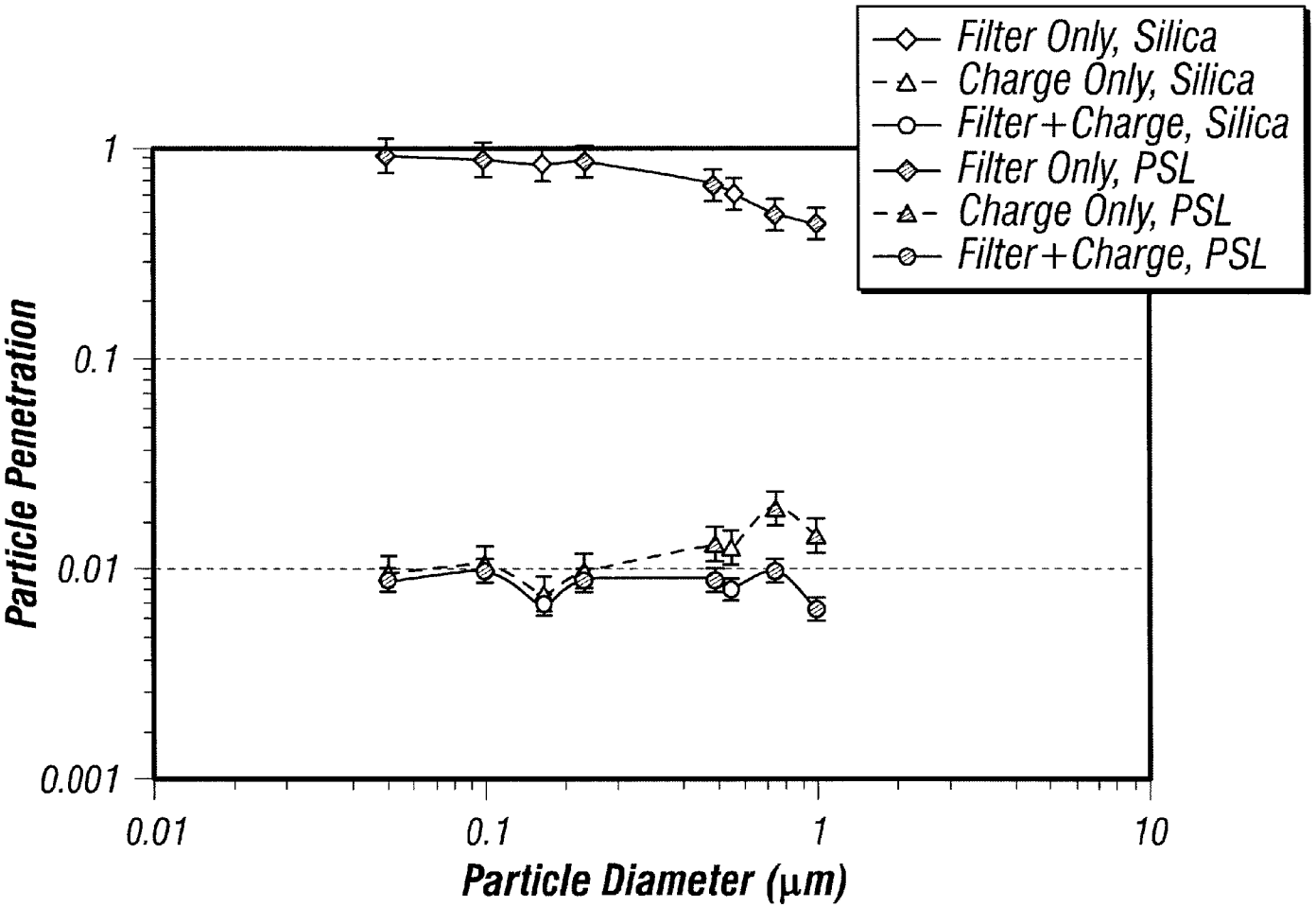
FIGS. 3(A)–3(D) show a plot of particle penetration at four different face velocities as a function of particle size.
Figure 3B:
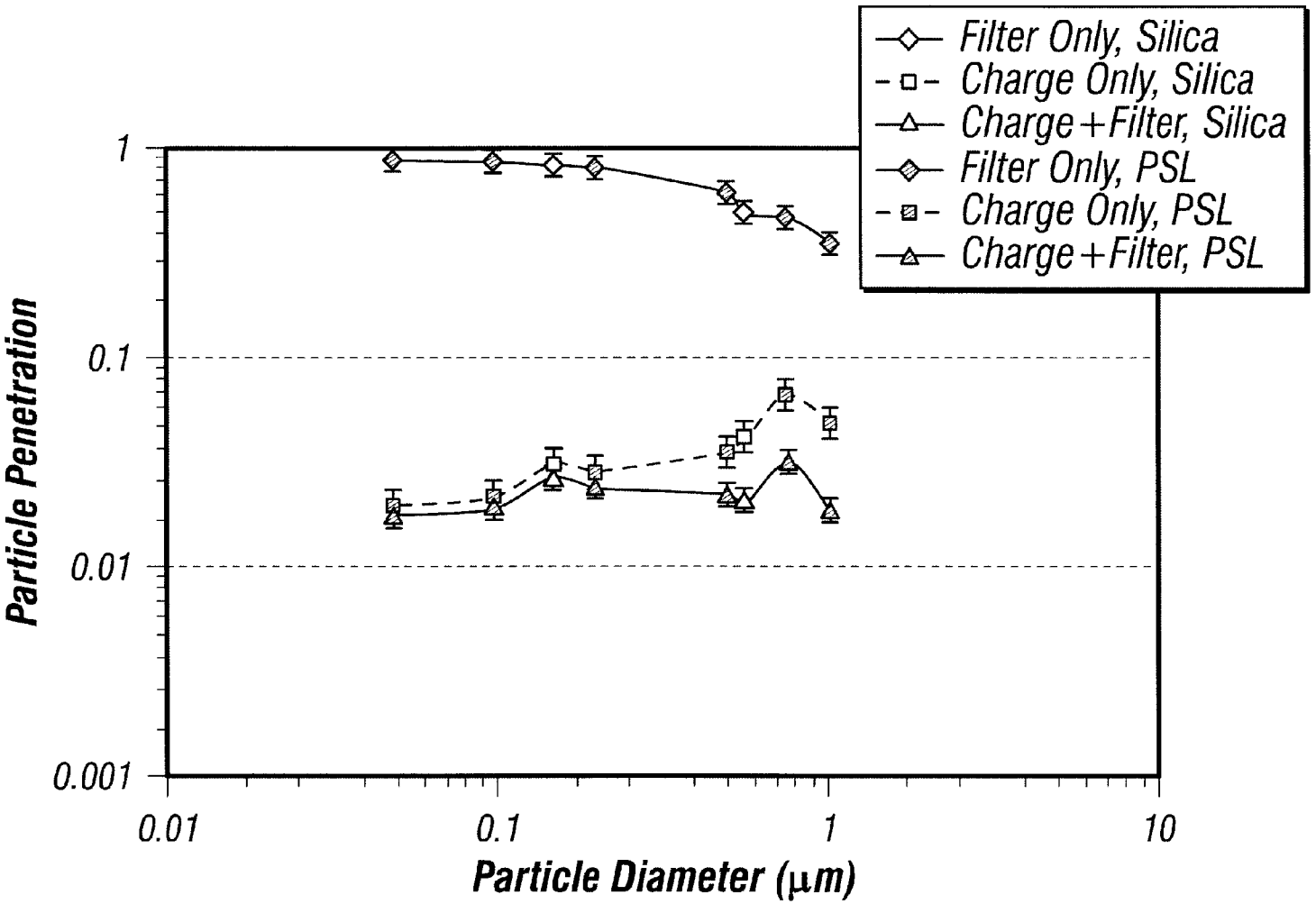
Figure 3C:
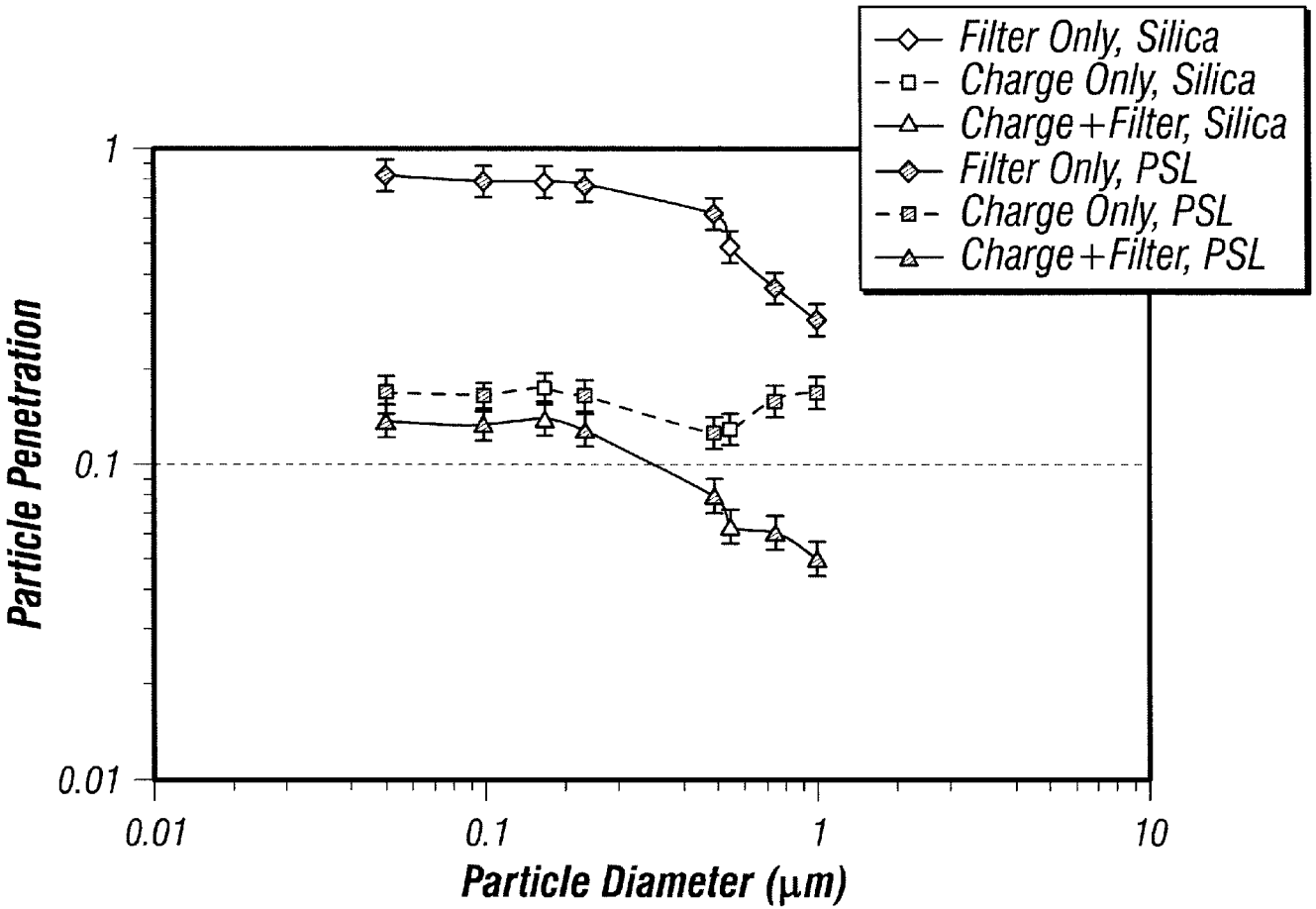
Figure 3D:
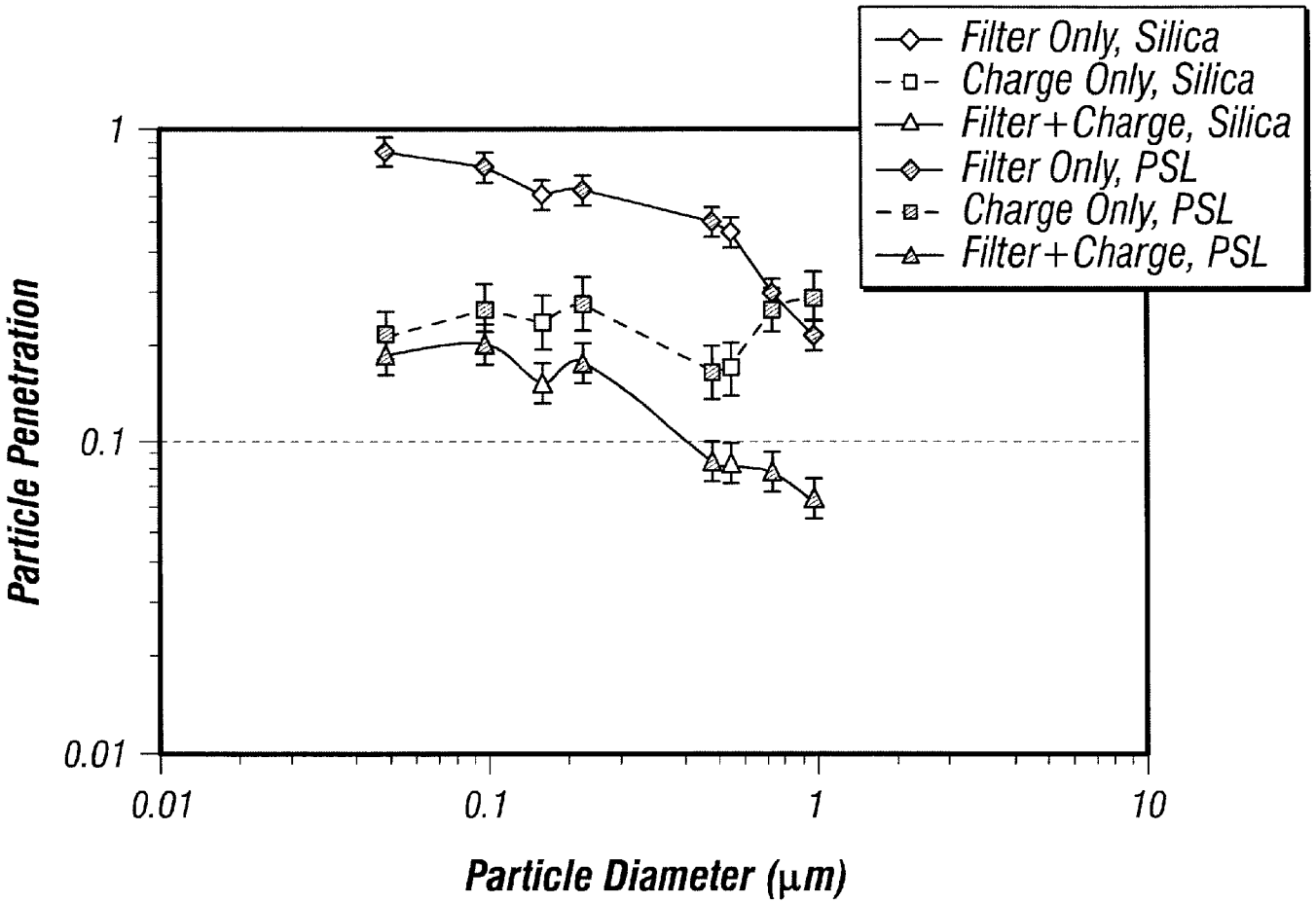

The data in FIG. 3(A) (as well as FIGS. 3(B)–3(D)) do not indicate any significant dependence on particle composition, as the penetration values for PSL (solid data labels) and silica particles (transparent data labels) seem to be quite similar. Thus, it can be seen that particle penetration decreases from about 40–95% to 1–3% with the onset of the electrical field, for a filter face velocity of 50 cm/s. The effect of the electrical field becomes less dramatic, but still considerable, at higher face velocities, particularly for the larger sizes of the 0.05–1 $\mu$m size range (e.g., 0.75–1 $\mu$m), as the residence time of particles in the point-to-plane electrical field formed between the wires 20 and the filter 15 decreases.

At a face velocity of either 100 or 125 cm/s, particle removal efficiency due to the filter itself becomes comparable to that due to the electrical field, as each mechanism results in an approximate particle penetration of about 20% to 30%. The overall reduction in particle penetration using the electrical field is still quite significant for all particles in the range of 0.05–1 $\mu$m. Particle penetration decreases from a range of approximately 25–80% down to a range of 6–20% with the onset of the electrical field, even at these high face velocities. The somewhat lower penetration values observed for particles bigger than 0.75 $\mu$m are due to the additional particle removal due to impaction at these high face velocities.

The results of FIGS. 3(A)–3(D) indicate that the contribution of the electrical field in reducing particle penetration is far greater than that of the filter itself. Particle removal of the uncharged filter becomes comparable to that of the filter with the onset of the field only for particles larger than about 0.75 $\mu$m and at face velocities exceeding 100 cm/s.

It should be noted that the face velocities at which the illustrative experiments were conducted are considerably higher than those typically used in standard filtration, including Electret filters (filtration velocities typically range from 1–15 cm/s). Regardless of face velocity, the net effect of electrostatic charging on reducing particle penetration seems to be relatively independent of particle size, as the results of FIGS. 3(A)–3(D) indicate.

Figure 4:
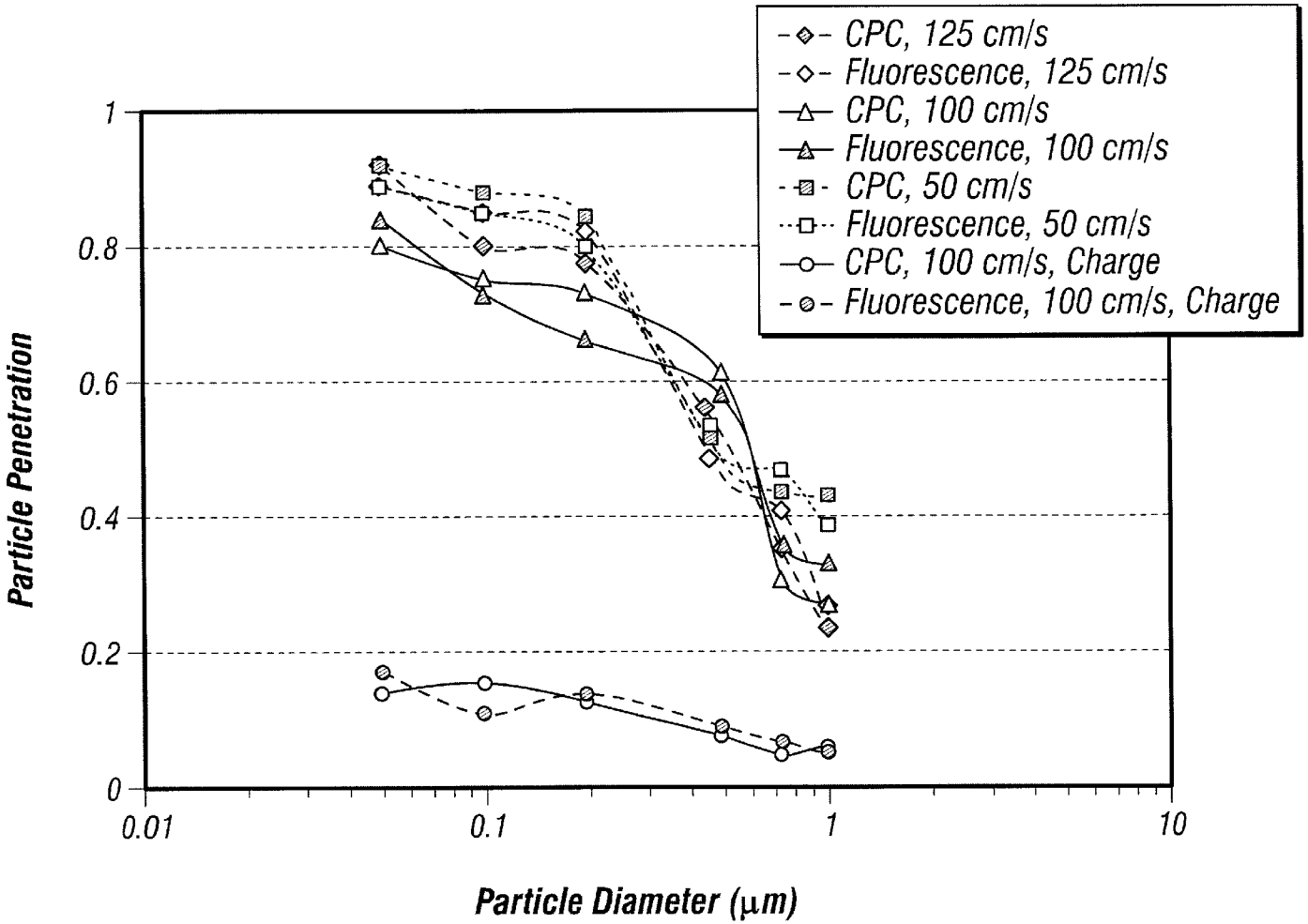
FIG. 4 graphically shows a comparison of penetration values changes in penetration with varying particle size at different velocities.

FIG. 4 shows the comparison in the filter penetration values determined using CPC 45 and fluorescence detection.

Particle penetration determined by means of the CPC as well as fluorescence detection is listed as a function of particle size for different filter face velocities. For each filter face velocity, paired t-test comparisons were conducted between the penetration values measured using the CPC 45 and those measured using fluorescence detection. The results of this comparison, along with the correlation coefficients and p-values are shown in Table 1 appearing at the end of the Detailed Description. The results of FIG. 4 and Table 1 clearly indicate that there is no significant difference in the penetration values determined by either method. It can therefore be concluded that particle counts are only related to the generated fluorescent aerosol. The CPC 45 was used in the rest of the experiments because of its simplicity and its very fast response.

Figure 5:
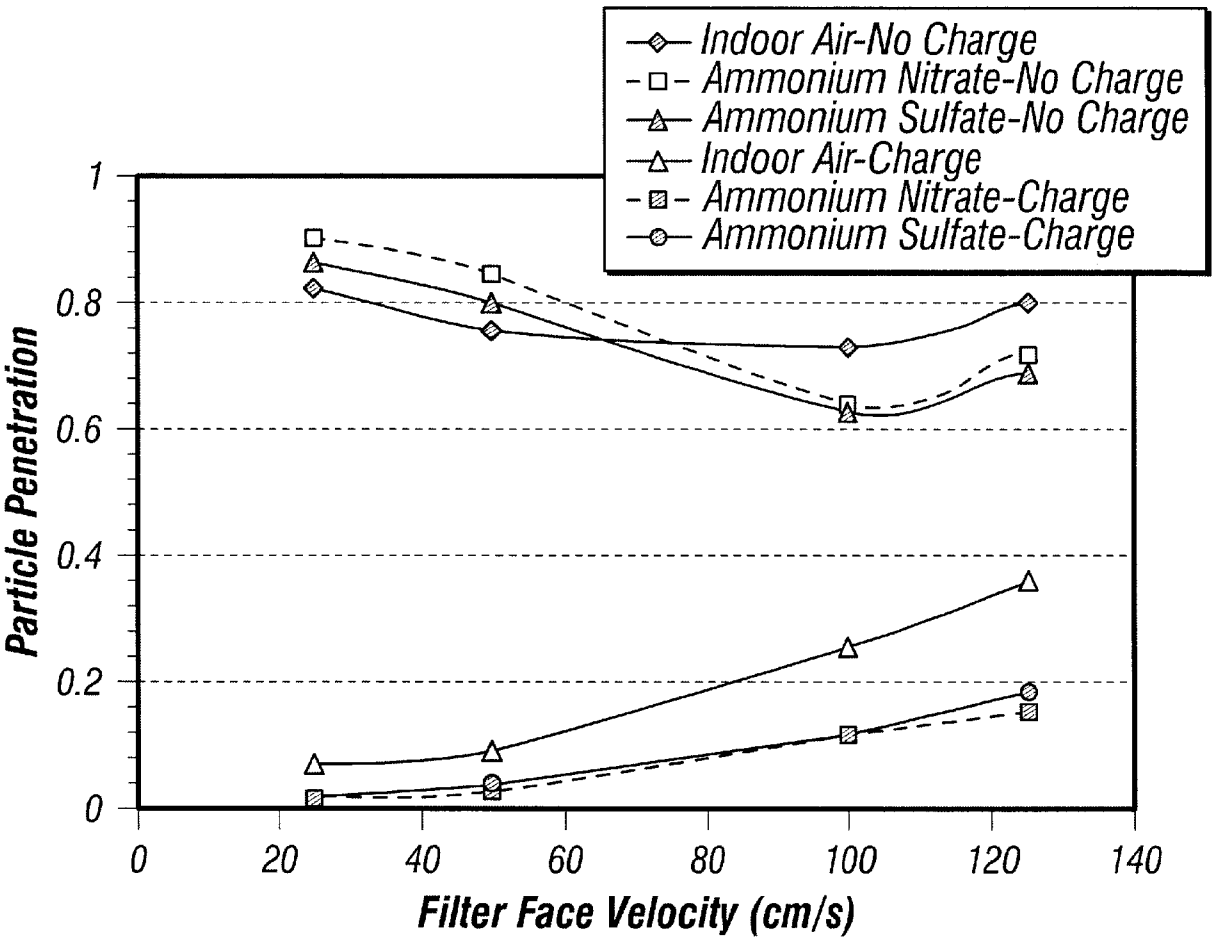
FIG. 5 shows the results of ultrafine sulfate, nitrate, and indoor air with different face velocities.

FIG. 5 shows particle penetration as a function of face velocity for the polydisperse ammonium nitrate, ammonium sulfate and ultrafine indoor air particles. The size distributions based on mass determined with the MOUDI indicated that the mass median diameters (MMD) for nitrate and sulfate were approximately 0.18 and 0.21 $\mu$m, respectively, while the geometric standard deviations (GSD) were in the range of 1.8–2.1. Particle concentrations are measured with CPC 45 and are expected to be dominated by the contributions of ultrafine (e.g., smaller than 0.1 $\mu$m) particles. Approximate estimates of the nitrate and sulfate size distributions based on particle counts can be obtained from the following equation:

$$CMD = \frac{MMD}{\rho_p \exp(3\ln^2 GSD)} \tag{4}$$

where CMD is the count median diameter and $\rho_p$ is the particle density. Based on equation (4) and our previous measurements, the CMD for nitrate and sulfate aerosols should be in the range of 0.06 to 0.07 $\mu$m.

As the results of FIG. 5 indicate, the performance of the filter with and without the presence of the electrical field is similar for both aerosols and at any face velocity. At a face velocity of 25 cm/s, the penetration of nitrate and sulfate particles is reduced from about 85% to less than 1%. As the face velocity increases to 50 cm/s, particle penetration decreases from about 80% to 2% with the use of the electrical field. Increasing the face velocity further to 100 and 125 cm/s results in decreasing the penetration from about 60%–70% to about 10–15%. Similar to the results obtained with monodisperse PSL and silica particles, the reduction in particle penetration becomes more pronounced at lower face velocities, probably due to the longer time available for particle charging as well as the longer residence time of particles in the filter.

The values for nitrate and sulfate particle penetration agree well with those obtained for PSL particles in the size range of 0.05 to 0.1 $\mu$m, thereby indicating that the differences in particle chemical composition, thus electrical permittivity, do not significantly affect the performance of the grounded filter.

Capacity Tests

Figure 6:
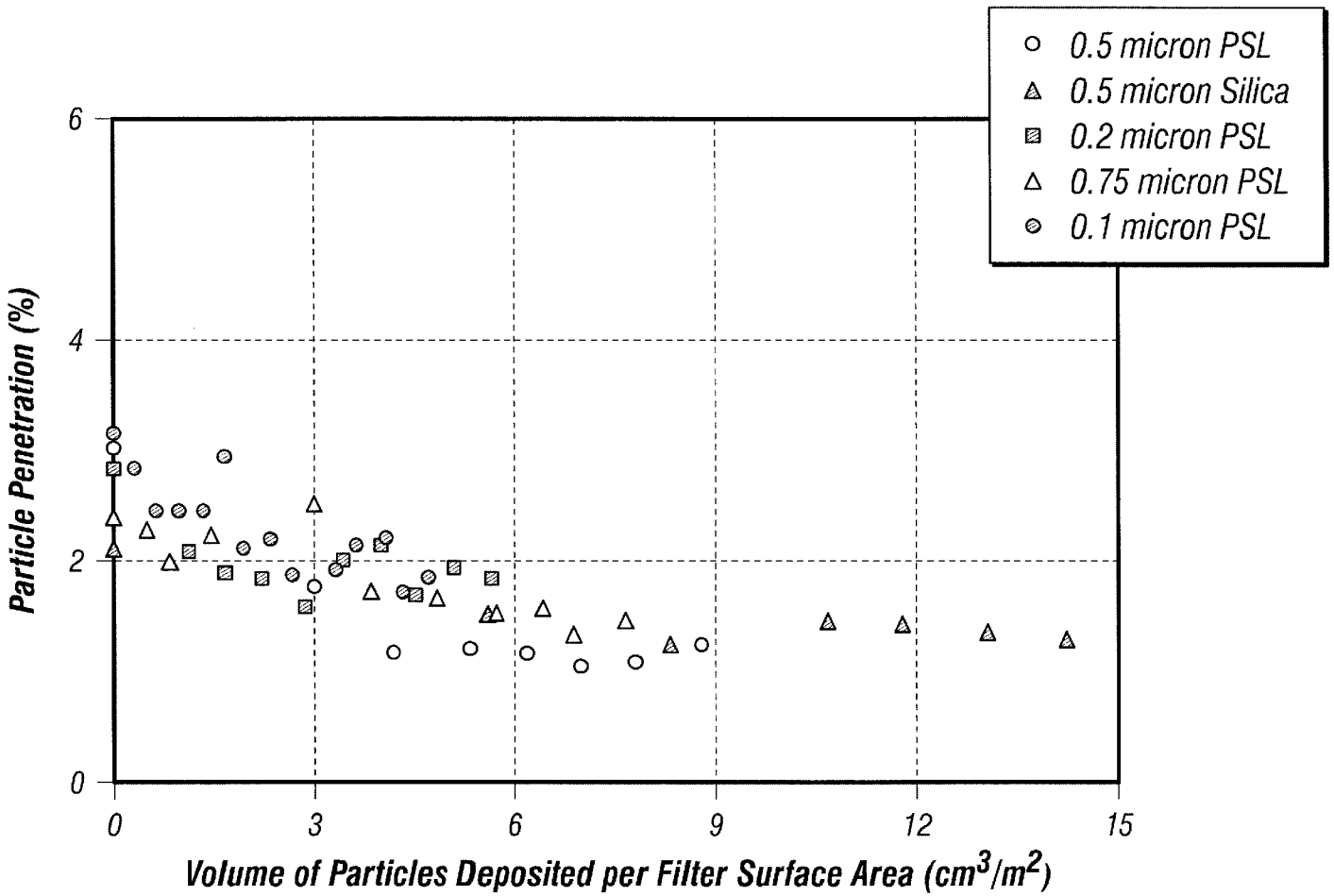
FIG. 6 shows the changes of penetration with particle loading when filter face velocity is 50 cm/s.
Figure 7:
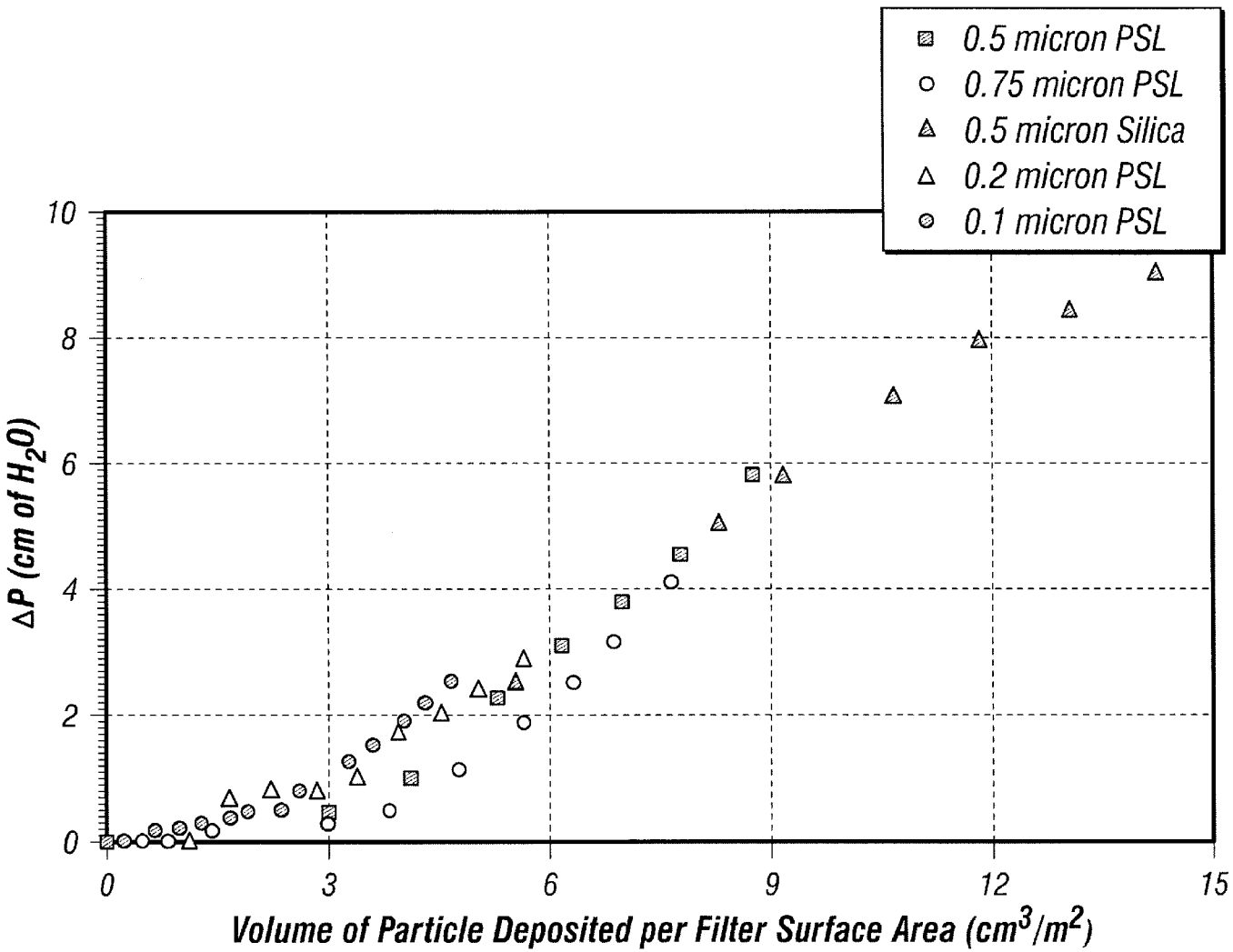
FIG. 7 shows the changes of pressure drop with particle loading when filter velocity is 50 cm/s.

FIGS. 6 and 7 show the results from the capacity tests conducted for 0.1, 0.2, 0.5 and 0.75 $\mu$m PSL as well as for 0.15 and 0.5 $\mu$m silica particles. A face velocity of 50 cm/s was chosen for the capacity tests as a compromise between a low enough velocity (resulting to low initial penetration values) and a high enough face velocity for adequate loading within a reasonable amount of time. Previous studies on pressure drop with loading for fibrous filters have shown that the change in the pressure across a filter with particle loading is inversely proportional to the particle diameter and particle density. In order to normalize for particle density and focus only on the effect of particle size, we expressed both particle penetration as well as the increase in pressure drop as a function of particle volume deposited per filter surface area (in $cm^3/m^2$). (Particle density is 1.05 and 2.2 $g/cm^3$ for PSL and silica particles, respectively.) A maximum of 15 $cm^3/m^2$ (corresponding to 33 $g/m^2$ for 0.5 $\mu$m silica particles) was loaded on the stainless steel filter 15 in the experimental arrangement of FIG. 1.

The results of FIG. 6 reveals a slight decrease in particle penetration with loading. Particle penetration decreases almost by half, from a range of 2 to 3% to about 1.5% as particle loading reaches 15 $cm^3/m^2$. There is no obvious relationship between the decrease in penetration and particle size. The observed decrease in penetration is most likely due to some filter clogging with a subsequent increase in pressure drop, which is shown in FIG. 7. This observation is in good agreement with the previous literature on clogging of fibrous as well as Electret filters.

The results from the capacity tests confirm that particle penetration of the grounded filter does not increase with loading. This is a very important finding, as it indicates that the accumulation of particles of non-conductive material does not create "back corona". Back corona would substantially decrease the collection efficiency of the grounded filter 15. By comparison, the performance of electrically active fibrous filters rapidly degrades as particle loading exceeds 2–3 $g/m^2$. Previous studies have shown that, depending on particle size and face velocity, particle penetration of a 20 $\mu$m fiber Electret filter nearly doubles at particle loadings of 3–5 $g/m^2$. Although such studies were conducted in a limited range of particle sizes (0.46 to 1.4 $\mu$m ) and face velocities (10 to 80 cm/s), they showed that particle penetration generally increases more rapidly at smaller particle sizes and at higher face velocities. The degradation in the performance of the associated filter was attributed to the "screening" of the fiber charge by the charge carried by the deposited particles.

The increase in pressure drop with particle loading (expressed in $cm^3$ of deposited particles per $m^2$ of filters surface area) with regard to the experimental arrangement is plotted with respect to particle size in FIG. 7. For each particle size, the pressure drop increases slowly until particle loading reaches the range of approximately 1–1.5 $cm^3/m^2$. The increase in pressure drop with loading then becomes quasi-linear, with a substantially higher slope than that of the initial loading stage.

For each particle size and type, estimates of the average increase in pressure drop with particle loading were obtained by performing linear regression between the increase in pressure drop and the particle loading data. The results of the linear regression are summarized in Table 2. The slopes of the regression lines, which represent a measure of the average increase in pressure drop per unit particle loading, indicate that the increase in pressure drop does not depend on particle size, at least for the size range tested (0.1 to 0.75 $\mu$m). The average increase in pressure drop varies from 0.59 to 0.70 cm of $H_2O$ per $cm^3/m^2$ of particle loading. All intercepts in the linear regressions are not different from zero at a p-value of 0.05. Moreover, as the results of Table 2 indicate, the pressure drop data and particle loading data were highly correlated for all particle sizes ($R^2$ varied from 0.91 to 0.98).

Theoretical and experimental studies on the loading characteristics of fibers filters have shown that in general, the rate of increase in pressure drop is higher for smaller particles because they form dendrites more rapidly than larger particles. By contrast, the above experimental results revealed that the charged particles are deposited along the filter fibers uniformly, thereby increasing the "effective" fiber diameter and hence the filter solidity.

SUMMARY

The above experiment setup confirms the advantages of using a stainless steel fibrous filter 15 as the ground electrode of a point-to-plate electrostatic precipitator 11 on particle penetration. The filter medium used in the experiments was made of standard AISI 316L stainless steel, with a fiber diameter of 20 $\mu$m.

However, any metal fibrous filter made of similar alloy may also be used. The filter 15 was connected to the ground electrode 18 of a high-voltage power supply 19, while four 0.2-cm wires 20 served as the particle charging electrodes of the point-to-plate precipitator 11.

The wires 20 ended in a conical tip 20, and were placed at a distance of 1.25 cm from the filter 15. A positive 14 kV DC voltage was applied to the wires 20. The effect of the electrical field on particle penetration was investigated at four different filter face velocities (25, 50, 100 and 125 cm/s), for monodisperse PSL and silica particles (size range 0.05 to 1 $\mu$m) as well as polydisperse ammonium sulfate, ammonium nitrate, and ultrafine indoor air particles.

Particle penetration was greatly reduced by the application of the electrical field. Depending on the filter face velocity, the onset of the field resulted in reducing particle penetration by a factor of approximately 5 to 50, with greater reductions achieved at the lower face velocities (e.g., 25 and 50 cm/s). The reduction in particle penetration was independent of particle resistivity since the experiments showed similar particle removal for non-conductive PSL and silica and conductive ammonium sulfate and nitrate particles. The effect of particle loading on particle penetration was also investigated at a filter face velocity of 50 cm/s. Particle penetration seemed to slightly decrease with particle loading. This decrease was independent of particle size. These results indicate that the accumulation of particles of non-conductive material up to 15 $cm^3/m^2$ does not create "back corona", which would substantially decrease the collection efficiency of the grounded filter. By comparison, the performance of electrically active fibrous filters has been shown to rapidly degrade as particle loading exceeds 2–3 $g/m^2$.

It should be appreciated that using a stainless steel filter as the collector plate of an electrostatic precipitator may also eliminate particle reentrainment, a problem frequently encountered in electrostatic precipitators when excessive accumulation of particulate matter occurs on the collector. In order to avoid overloading, which would result in particle resuspension as well as "back corona", most precipitators use mechanical removal devices, such a vibrators or rappers, to remove particles from the collector electrode into some type of a dust hopper, usually placed on the bottom of the precipitator. Particle resuspension is less likely to occur when the air flow is directed towards the collection electrode (as opposed to parallel, which is the case of conventional electrostatic precipitators). Furthermore, even if resuspension occurs, particles will most likely be collected again by the filter.

It should further be appreciated that the above experiments were conducted on a filter constituted by generally flat plate. However, other configuration are also contemplated including a generally cylindrical-shaped filter.

Those skilled in the art will understand that the preferred embodiments that are described hereinabove, including the below Tables 1 and 2, can be subjected to apparent modifications without departing from the true scope and spirit of the invention.

TABLE 1

Summary of the statistical paired comparisons between the penetration values determined using the 3022 Condensation Particle Counter (CPC) and fluorescence detection.

| Filtration Velocity (cm/s) and Filter Configuration | p-value | Correlation Coefficient[b] |
|---|---|---|
| 125, no charge | 0.48 | 0.98 |
| 100, no charge | 0.83 | 0.98 |
| 50, no charge | 0.25 | 0.99 |
| 100, charged filter | 0.77 | 0.80 |

[a]p-value of paired t-test particle penetration values measured using the CPC and by means of fluorescence detection.
[b]correlation coefficient between particle penetration values measured using the CPC and by means of fluorescence detection.

TABLE 2

Summary of the linear regression of the increase in pressure drop on particle loading. Filter face velocity: 50 cm/s

| Particle Size and Type ($\mu$m) | Intercept (cm of $H_2O$) | Slope (cm of $H_2O$ per $cm^3/m^2$) | SE[b] (cm of $H_2O$ per $cm^3/m^2$) | Correlation Coefficient ($R^2$) |
|---|---|---|---|---|
| 0.1 PSL | −0.51 | 0.59 | 0.04 | 0.93 |
| 0.2, PSL | −0.70 | 0.65 | 0.05 | 0.98 |
| 0.5, PSL | −1.09 | 0.70 | 0.1 | 0.91 |
| 0.5, silica | −0.41 | 0.67 | 0.04 | 0.98 |
| 0.75, PSL | −1.39 | 0.64 | 0.08 | 0.95 |

[a]All intercepts are not statistically different than zero at p = 0.05
[b]Standard error of the slope.

What is claimed is:

1. An electrically enhanced point-to-plane precipitator comprising:

a metal fibrous filter adapted for coupling to a grounded electrode of a power supply; and particle charging electrodes pointed in the direction of the metal fibrous filter and adapted for coupling to a non-grounded electrode of the power supply, said metal fibrous filter being orientated such that a gaseous stream is drawn from the charging electrodes toward and through said metal fibrous filter to effect particle filtration by deposition of said particles upon said fibrous filter during application of an electrical field across the grounded and non-grounded electrodes of the power supply, and wherein said fibrous filter is to effect particle filtration of at least some particles having a size of about 1 $\mu$m or less from said gaseous stream.

2. The precipitator of claim 1, wherein the metal fibrous filter is a stainless steel filter.

3. The precipitator of claim 2, wherein the stainless steel filter is an AISI 316L stainless steel filter.

4. The precipitator of claim 1, wherein the metal fibrous filter is made of randomly laid, sinter-bonded fibers providing at least 70% open area fixed pore size.

5. The precipitator of claim 4, wherein the metal fibrous filter is a stainless steel filter.

6. The precipitator of claim 1, wherein said metal fibrous filter is of pleated construction.

7. The precipitator of claim 1, wherein at least one of the particle charging electrodes is wire-shaped and includes a proximal end relative to the metal fibrous filter so as to facilitate corona charge.

8. The precipitator of claim 1, wherein the particle charging electrodes are substantially orientated to facilitate even distribution of particle charging over a facing surface of the metal fibrous filter.

9. The precipitator of claim 8, wherein the facing surface is a generally flat plate.

10. The precipitator of claim 7, wherein the metal fibrous filter is generally cylindrical.

11. The precipitator of claim 7, wherein the metal fibrous filter is a generally flat plate.

12. A method of electrically enhancing particle filtration by a point-to-plane precipitator, comprising:

applying an electrical field between each of plural particle charging electrodes and a grounded metal fibrous filter, the particle charging electrodes being pointed in the direction of the metal fibrous filter and connected to a power supply;

supplying a gaseous stream drawn from the charging electrodes toward and through the metal fibrous filter to effect particle filtration by deposition of said particles upon said fibrous filter; and filtering at least some particles having a size of about 1 $\mu$m or less from the gaseous stream.

13. The method of claim 12, wherein the metal fibrous filter is a stainless steel filter.

14. The method of claim 13, wherein the stainless steel filter is an AISI 316L stainless steel filter.

15. The method of claim 12, wherein the metal fibrous filter is made of randomly laid, sinter-bonded fibers providing at least 70% open area fixed pore size.

16. The method of claim 15, wherein the metal fibrous filter is a stainless steel filter.

17. The method of claim 12, wherein said metal fibrous filter is of pleated construction.

18. The method of claim 12, wherein at least one of the particle charging electrodes is wire-shaped and includes a proximal end relative to the metal fibrous filter so as to facilitate corona charge.

19. The method of claim 12, wherein the particle charging electrodes are substantially orientated to facilitate even distribution of particle charging over a facing surface of the metal fibrous filter.

20. The method of claim 19, wherein the facing surface is a generally flat plate.

21. The method of claim 18, wherein the metal fibrous filter is generally cylindrical.

22. The method of claim 18, wherein the metal fibrous filter is a generally flat plate.

* * * * *